US005136965A

United States Patent [19]

Tamburro, Jr.

[11] Patent Number: 5,136,965

[45] Date of Patent: Aug. 11, 1992

[54] PART NUMBER SLIDE RULE APPARATUS

[76] Inventor: Louis Tamburro, Jr., 1144 Galahad Dr., Casselberry, Fla. 32707

[21] Appl. No.: 806,256

[22] Filed: Dec. 13, 1991

[51] Int. Cl.[5] ..... G09F 11/00

[52] U.S. Cl. ..... 116/321

[58] Field of Search ..... 40/488, 491; 116/321, 116/322, 323, 324; 235/69, 70

[56] References Cited

U.S. PATENT DOCUMENTS 1,174,315 3/1916 Harmon ..... 235/69

3,386,653 6/1968 Phipps ..... 235/70 R

*Primary Examiner*—William A. Cuchlinski, Jr.

*Assistant Examiner*—W. Morris Worth

*Attorney, Agent, or Firm*—William M. Hobby, III

[57] ABSTRACT

A part number slide rule apparatus for displaying a company part number by the position of a plurality of slide members relative to a body member has a body member supporting a plurality of sliding slide members therein. The body member has a plurality of elongated openings therein each having indicia thereon indicative of a gauge feature and also having a plurality of part number openings. A plurality of slide members are slidably mounted in the body member and each slide member has a pointer thereon in a predetermined position and a plurality of part number indicia portions positioned thereon, each part number indicia portion being alignable with one of the body member part number openings in the body member when the slide member pointer is positioned to point at selected indicia on the body member indicative of a feature of a gauge. Sliding each of the plurality of slide members to align their respective pointers at selected indica aligns selected components of a company's gauge part number to display the complete recommended gauge part number.

9 Claims, 2 Drawing Sheets

PART NUMBER SLIDE RULE APPARATUS

BACKGROUND OF THE INVENTION

The present invention relates to a part number slide rule for displaying a company part by the position of a plurality of slide members sliding therein relative to the body member.

In the past, a great variety of slide rule type devices have been utilized for making mathematical calculations as well as determining the various types of features for machinery and calculating design features. These prior art slide rule devices typically have body members with sliding members sliding therein and typically have openings in the body member for displaying indicia. In addition, the slide members may slide relative to each other for aligning indicia between slide members. Many slide rule type devices are circular, rotating one wheel portion relative to another wheel portion for aligning openings or aligning annular positioned indicia with indicia on different wheels.

The present invention is a slide rule type device for displaying a selected company's part number by the movement of a plurality of slide members within a body member to align pointers up with desired features for determining a part number. Specifically, the present slide rule is directed towards selecting the part number for a gauge based on factors such as dial size, pressure, case material, internal materials, stem size, connecting position indicia, and vacuum indicia.

Prior art U.S. patents which relate to various slide rule type devices can be seen in the Blakeley et al. U.S. Pat. No. 2,832,539, the Bulow U.S. Pat. No. 2,983,447, the Sommer U.S. Pat. No. 944,218, and in the Todd U.S. Pat. No. 271,949. Each of these patents teaches a type of calculating device for making various types of calculations and each uses some type of sliding member relative to a body member or to other sliding members. In the Goldfien U.S. Pat. No. 2,454,157, a slide rule sliding members is used for designing sewers and solving problems in sewer design. In the Gaudier-Pons U.S. Pat. No. 3,146,942, a paint calculating slide rule is provided having a plurality of stacked sliding members for calculating quantities of paint dependent upon surface area. The Fukute U.S. Pat. No. 4,775,779, is a slide rule for selecting material for constructing bearings and uses a plurality of slidable members. The Wiken U.S. Pat. No. 3,091,389, is a slide rule gear select having a plurality of sliding members adapted to facilitate the selection of gears suitable for specific power transmission applications. The Carran, Jr. U.S. Pat. No. 2,657,610, is a tabular device for musical modulation which uses a body member with a plurality of slides for use in determining musical arrangements to determine the cords by which the musician may modulate a musical composition from one key to another. The Newton U.S. Pat. No. 4,425,499, teaches a decision tree graphical computer which has slidable plates with openings therein sliding in a body member and also having openings therein and specifically designed to assist decision making in monitoring and controlling processes and more specifically for monitoring a nuclear power generation plant.

In contrast, the present invention is to help salesman and potential purchasers of a product, such as a gauge, to easily enter the information that they desire for a gauge and which provides an output part number for the particular company providing the part number slide rule. Thus, anyone trying to determine which gauge to purchase can enter the various criteria, such as dial size, pressure, case material, stem size, and the like, and can produce the exact part number for the gauge needed for a particular application.

SUMMARY OF THE INVENTION

A part number slide rule apparatus for displaying a company part number by the position of a plurality of slide members relative to a body member has a body member supporting a plurality of sliding slide members therein. The body member has a plurality of elongated openings therein each having indicia thereon indicative of a gauge feature and also having a plurality of part number openings. A plurality of slide members are slidably mounted in the body member and each slide member has a pointer thereon in a predetermined position and a plurality of part number indicia portions positioned thereon, each part number indicia portion being alignable with one of the body member part number openings in the body member when the slide member pointer is positioned to point at selected indicia on the body member indicative of a feature of a gauge. Sliding each of the plurality of slide members to align their respective pointers at selected indica aligns selected components of a company's gauge part number to display the complete recommended gauge part number.

BRIEF DESCRIPTION OF THE DRAWINGS

Other objects, features, and advantages of the present invention will be apparent from the written description and the drawings in which.

DESCRIPTION OF A PREFERRED EMBODIMENT

Figure 1:
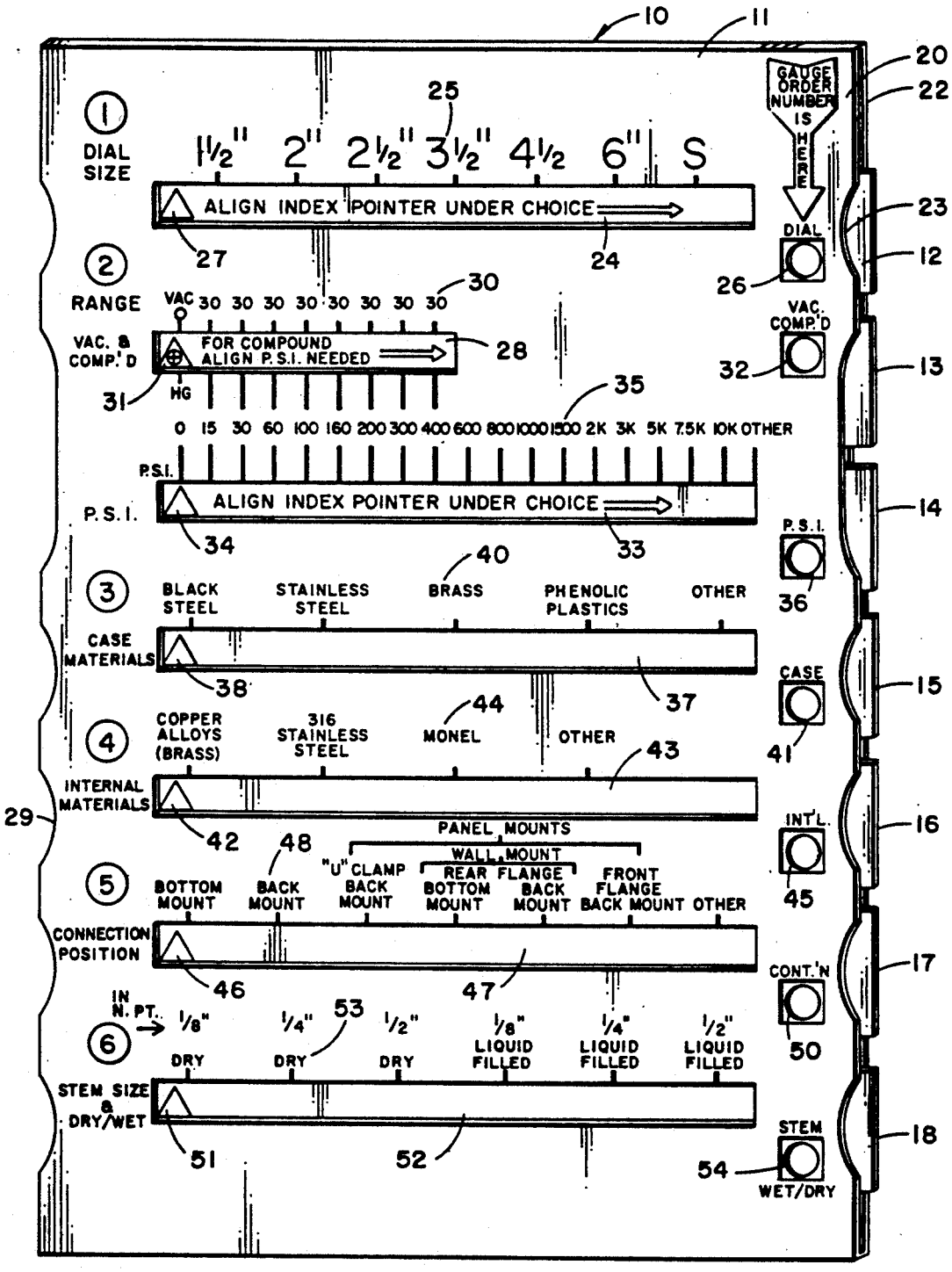
FIG. 1 is a perspective view of a part number slide rule in accordance with the present invention.
Figure 2:
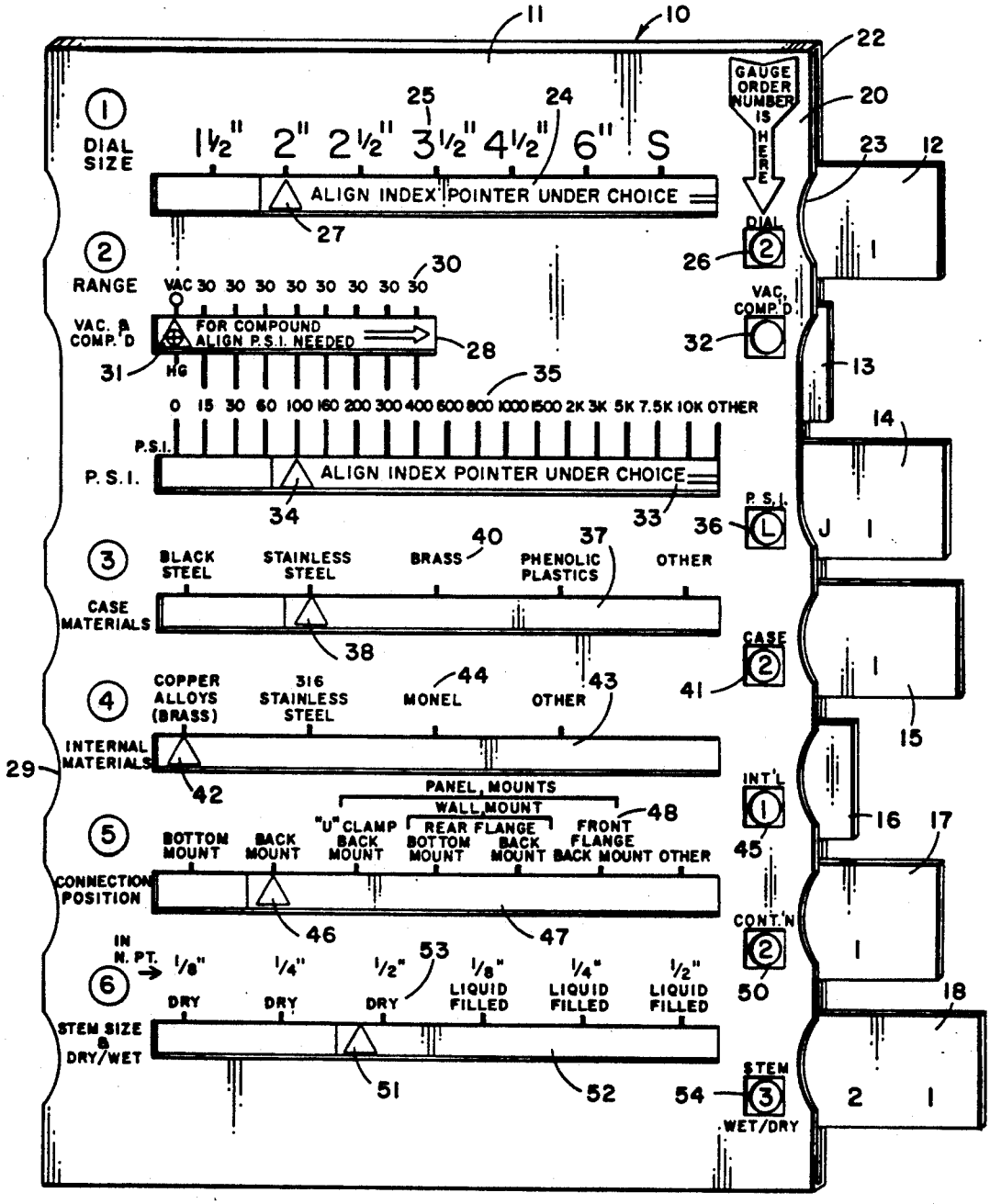
FIG. 2 is a perspective view of a part number slide rule in accordance with FIG. 1 having the slides positioned for determining a part number.

Referring to the drawings, FIG. 1 and 2, a part number slide rule calculator 10 is illustrated having a body member 11 and slide members 12, 13, 14, 15, 16, 17, and 18. The body member 11 has a front panel 20 and a rear panel 22 and has arcuate cutouts 23 and 29 at each slide member protrusion from between the panels 20 and 22 to enable a person's fingers to grasp an individual slide from either side thereof.

The body member 11 has an elongated slot 24 with a plurality of indicia 25 therealong indicating a number of dial sizes for a gauge. A small opening 26 is associated with the slide member 12 to indicate a portion of a part number when slide member 12 is slid to a position pointing a pointer 27 thereon to one of the gauge sizes 25, as shown in FIG. 2. An elongated slot 28 has indicia 30 thereon associated with the sliding of the slide member 13 and having a pointer 31 when positioned against the appropriate indicia 30 will align a part number portion with an opening 32. An elongated opening 33 is associated with the slide 14 which is moved to slide the pointer 34 to a position in alignment with the indicia 35 indicative of pressure (PSI) and which aligns a portion of a part number with a part number opening 36. A slot 37 in the panel 20 of the fixed member 11 is associated with a slide member 15 to slide a pointer 38 in alignment with indicia 40 along the elongated slot 37 to indicate case material and to align a portion of a part number in part number opening 41. Slide member 16 slides an arrow 42 within an elongated slot 43 to align with indicia 44 indicative of internal materials for a gauge and aligns a portion of a part number with the part number opening 45. Slide member 17 slides a pointer 46 on the slide member 17 in the slot 47 within the body member 11 for aligning the arrow 46 with the indicia 48 indicative of the connection position for a gauge which in turn aligns a part number on the slide 17 with a part number portion opening 50. Slide 18 slides a pointer 51 on the slide 18 within a slot 52 in the body member 11 for aligning the arrow 51 with the indicia 53 indicative of the stem size and dry/wet. The sliding the slide 18 to align the pointer 51 aligns a part number portion indicia with the part number portion opening 54.

In operation, the slide rule apparatus of FIG. 1 is shown in its original position before operation and is grasped by a user which then slides each of the slide members 12 to 18 within the body member 11 to align each of the pointers with selected indicia. As shown in FIG. 2, slide 12 has been aligned with a two inch dial size to place a (2) in the gauge order number portion opening 26. Slide 13 does not require positioning while slide 14 has been positioned at 100 psi to align an (L) in the psi part number opening 36. Slide 15 has positioned the arrow 38 with stainless steel to indicate a case material part number portion (2) in the opening 41. Slide 16 has been positioned on copper alloys and brass to indicate a (1) in the part number portion opening 45. Slide 17 has been positioned with the pointer 46 on the back mount to indicate a (2) in the opening 50 and slide 18 has been positioned on the ½" dry stem size to align a three-part number with the opening 54 so that the part number can then be read off the slide rule as 2-L2123 to indicate a particular part number of a company so that a customer can then determine the exact part number to order for the exact gauge needed for his equipment. This simplifies the calculation and allows not only salesman but customers to readily calculate in a very rapid manner the exact part number they need for a particular company's gauge and then to place that order with the company. This assists the company with making sales with their gauges over a competitor's gauges because of the ease in calculating the part number which would only be useful with the particular company's gauges.

It should be clear at this point that a part number slide rule for displaying a companies part number for ordering a particular gauge has been provided. However, the present invention is not to be limited to the forms shown, to ordering of gauges, but are to be considered illustrative rather than restrictive.

I claim:

1. A part number slide rule for displaying a company part number by the position of a plurality of slide members relative to a body member comprising:

a body member having a pair of panels and plurality of elongated openings therein in one panel, each having indicia therealong indicative of a feature of a company's part and said body member also having a plurality of part number openings therein in one panel, each in predetermined spaced relationship with one elongated opening;

a plurality of slide members, each slide member being slidably mounted in said body member and each slide member having a pointer indicator thereon in a predetermined position and a plurality of part number indicia portions thereon indicative of a portion of a part number, each part number indicia portion being alignable with one said body member part number opening in said body member when said slide member pointer is positioned to point at selected indicia on said body member indicative of a feature of a company's part, whereby sliding each of a plurality of slide members to align there respective pointers at selected indicia aligns selected components of a company part number to display the complete recommended part number.

2. A part number slide rule for displaying a company part number by the position of a plurality of slide members relative to a body member in accordance with claim 1 in which said slide member part number indicia is for a gauge part number.

3. A part number slide rule for displaying a company part number by the position of a plurality of slide members relative to a body member in accordance with claim 2 in which said body member indicia along one elongated opening in said body member is dial size indicia.

4. A part number slide rule for displaying a company part number by the position of a plurality of slide members relative to a body member in accordance with claim 3 in which said body member indicia along one elongated opening in said body member is gauge P.S.I indicia.

5. A part number slide rule for displaying a company part number by the position of a plurality of slide members relative to a body member in accordance with claim 4 in which said body member indicia along one elongated opening in said body member is gauge case material indicia.

6. A part number slide rule for displaying a company part number by the position of a plurality of slide members relative to a body member in accordance with claim 5 in which said body member indicia along one elongated opening in said body member is internal materials indicia.

7. A part number slide rule for displaying a company part number by the position of a plurality of slide members relative to a body member in accordance with claim 6 in which said body member indicia along one elongated opening in said body member is stem size indicia.

8. A part number slide rule for displaying a company part number by the position of a plurality of slide members relative to a body member in accordance with claim 7 in which said body member indicia along one elongated opening in said body member is connection position indicia.

9. A part number slide rule for displaying a company part number by the position of a plurality of slide members relative to a body member in accordance with claim 8 in which said body member indicia along one elongated opening in said body member is vacuum indicia.

* * * * *